United States Patent [19]

Doros

[11] Patent Number: 4,789,764

[45] Date of Patent: Dec. 6, 1988

[54] PUSHBUTTON SWITCH WITH RESILIENT EXTENSIBLE PIVOTABLE CONTACT ELEMENT

[75] Inventor: Jacek P. Doros, Chicago, Ill.

[73] Assignee: Illinois Tool Works Inc., Chicago, Ill.

[21] Appl. No.: 136,013

[22] Filed: Dec. 21, 1987

[51] Int. Cl.[4] ..... H01H 13/52

[52] U.S. Cl. ..... 200/159 A; 200/241

[58] Field of Search ..... 200/159 A, 241, 246, 200/252, 257

[56] References Cited

U.S. PATENT DOCUMENTS

| | | | |
|---|---|---|---|
| 755,125 | 3/1904 | Friedberg | 200/159 A |
| 2,507,381 | 5/1980 | Morse | 200/159 A |
| 4,220,835 | 9/1980 | Storz et al. | 200/159 A |

*Primary Examiner*—Renee S. Luebke

*Attorney, Agent, or Firm*—Donald J. Breh; Thomas W. Buckman

[57] ABSTRACT

A push button operated electrical switch is disclosed including a resiliently deflectable contact element including a concavo-convex portion and a pivotable contact arm. Upon actuation, the concavo-convex portion deflects and extends contacting a ramp which causes the pivotable contact arm to pivot into wiping type contact with a stationary contact.

5 Claims, 1 Drawing Sheet

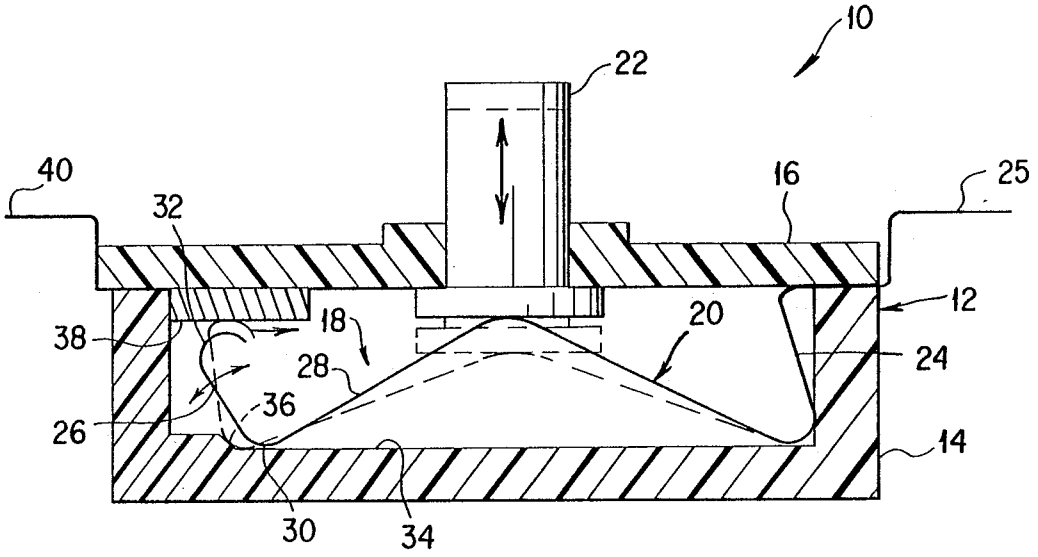
10
22
16
25
12
24
14
20
18
28
36
32
38
40
26
34
30

PUSHBUTTON SWITCH WITH RESILIENT EXTENSIBLE PIVOTABLE CONTACT ELEMENT

BACKGROUND OF THE INVENTION

This invention relates to an electrical switch. More particularly, the invention relates to a push button type switch mechanism having high reliability. In still further particularly, the invention relates to a push button switch using a resilient extensible pivotable contact element.

One recurrent problem associated with electrical switches is arcing of the contacts. Arcing can occur when the high and low potential contacts are positioned in close proximity to each other. Accordingly, either the potential difference between the terminal contacts has to be decreased, which is not always possible, or the gap or spacing of the contacts must be increased, thereby increasing the distances the various switch parts must travel which is not always desirable. Further, a wiping action of the moveable contact across the stationary contact is generally desirable which action helps keep the contacts clean and further minimizes arcing.

One switch using a resilient push button deflectable contact blade which wipes across a stationary contact is disclosed in the German Patent No. 2,359,971. This switch comprises an arcuate blade wherein one or both of the free ends of the blade spread apart to make and break contact with stationary contacts that are coplanar with the movement of the blade ends. While this mechanism creates a wiping action of the deflectable contact across the stationary contact, the device is still subject to arcing.

SUMMARY OF THE INVENTION

Accordingly, the present invention is directed to a push button operated switching mechanism of the general type described above which has reduced tendency to arc.

According to the invention, the switch includes a resiliently deflectable concavo-convex contact element which laterally deflects upon actuation by a push button and which further includes a pivotable portion that wipingly contacts a stationary contact.

According to an important feature of the invention, the pivotable portion of the contact element is a contact arm extending from one end of the contact element which is caused to pivot into contact with and wipe across the stationary contact upon extension of the concavo-convex portion of the contact element.

According to another feature of the invention, the switch housing is provided with means contacted by the contact element during extension thereof to pivot the pivotable contact arm.

According to a still further important feature of the invention, the means for pivoting the pivotable arm is a ramp provided on the switch housing contacted by the contact element at the junction of the concavo-convex portion and the pivotable contact arm portion of the contact element. Advantageously, the junction is rounded.

BRIEF DESCRIPTION OF THE DRAWING

The invention will be better understood after reading the following Detailed Description of the Preferred Embodiment in conjunction with the drawing which is a vertical cross sectional view of a switch according to the invention showing details of construction.

DETAILED DESCRIPTION OF THE PREFERRED EMBODIMENT

Shown in the drawing is a push button switch 10 having a non-conductive housing 12. In the switch shown, the housing 12 is a two piece construction including a body 14 and a cap or top 16. Other housing configurations are of course possible and that shown is only representative of a preferred construction. A resiliently deflectable contact element 18 is mounted in the housing and includes a generally concavo-convex deflectable portion 20 having its convex surface facing a push button 22. The push button 22 contacts the contact element at the center line of the concavo-convex portion which coincides with the centerline of the push button. Many forms of the contact element shape are possible including the V-shape shown or for example a U-shape. One end (the right end in the drawing) of the contact element is restrained against movement by provision of the upturned portion 24 being clamped between the top and bottom portions of the housing. A free end of the element is configured to form one stationary terminal 25 of appropriate design for connection to an external circuit.

The other end of the contact element is provided with a projecting contact arm 26 orientated generally perpendicular to one leg 28 of the concavo-convex portion. The junction 30 of the contact arm 26 and the leg 28 of the concavo-convex portion is preferably rounded. The free end of this contact arm is also rounded or arcuate shaped to form a moveable contact 32. The bottom wall 34 of the housing is provided with ramp 36 which is contacted by the rounded junction 30 during extension of the concavo-convex portion. The upper portion of the housing is provided with a stationary contact 38 and a second external terminal 40 for connection to the external circuit.

In operation, the push button 22 is linearly displaced downward from the unactuated position to the actuated position (shown in dashed outline) to actuate the switch. The concavo-convex portion deflects causing the leg portion 28 to move laterally away from the axis of the push button. The rounded junction 30 contacts the ramp 36 and upon further deflection of the concavo-convex portion begins to ride up the ramp slightly vertically moving the contact 32 toward the stationary contact 38. The contact arm 26 is simultaneously caused to pivot (clockwise in the drawing). The pivotable motion of the contact arm 26 causes the contact 32 to wipingly engage the stationary contact 38. Upon release of the push button, the resiliency of the contact element causes the element and push button to return to the unactuated position.

While the embodiment shown and described refers to a construction having a single pivotable contact arm, the invention is equally applicable to a switch having two pivotable contact arms and stationary terminals by providing a second pivotable contact arm, not shown, identical in construction and operation as the arm 26 in place of the upturned portion 24. Accordingly, a second stationary contact terminal, not shown, identical to contact terminal 38 and an additional ramp, not shown, similar to the ramp 30 for pivoting the second, pivotable contact arm would be provided on the housing.

Having described the preferred embodiment of the invention those skilled in the art can readily devise other embodiments and modifications which are to be considered to be within the scope of the appended claims.

What is claimed is:

1. A switch comprising:

a housing including a ramp;

actuator means mounted in said housing for movement between an unactuated position and an actuated position;

at least one stationary contact terminal mounted in said housing;

a resilient concavo-convex contact element mounted in said housing contacted substantially at the center of its convex surface by said actuator means, said contact element being generally extensible upon actuation by said actuator means and including a contact portion extending from one end of said contact element havign a free end spaced from said stationary contact terminal in the unactuated position, said contact element contacts said ramp upon extension and said contact portion pivots upon contact of said contact element with said ramp whereby said free end of said contact portion wipingly contacts said stationary contact terminal.

2. The switch as defined in claim 1 wherein said concavo-convex contact element is a V-shaped blade, and said contact portion includes a contact arm extending generally pependicularly from one end of said blade.

3. The switch as defined in claim 2 wherein a transition from said blade to said contact arm is rounded.

4. The switch as defined in claim 3 wherein said contact arm is generally arcuate shaped at its free end.

5. A switch comprising:

a housing;

at least one stationary contact terminal mounted in said housing;

a push button actuator mounted in said housing for linear displacement along an axis between an unactuated position and an actuated position;

a resilient contact element mounted in said housing and including a general concavo-convex portion having a centerline coinciding with the axis of said push button, the convex surface of said concavo-convex portion facing said push button, said contact element further including a contact portion extending from one end of said concavo-convex portion, said contact portion having a free end defining a moveable contact disposed spaced from said stationary contact terminal in the unactuated position, said one end of said concavo-convex portion being moveable away from said push button axis upon deflection of said concavo-convex portion by said push button when moved toward the actuated position; and ramp means located on said housing contacted by said one end of said concavo-convex portion during movement thereof away from the axis of said push button, for pivoting said contact portion whereby said moveable contact pivots and wipingly contacts said stationary contact terminal.

* * * * *